US009234384B2

(12) United States Patent
Cui

(10) Patent No.: US 9,234,384 B2
(45) Date of Patent: Jan. 12, 2016

(54) POWERED DOOR FOR NUCLEAR POWER PLANT

(71) Applicant: Yixing City Wanxiang Fireproof Doors Co., LTD, Yixing (CN)

(72) Inventor: JunQiang Cui, Yixing (CN)

(73) Assignee: YIXING CITY WANXIANG FIREPROOF DOORS CO., LTD, Yixing (CN)

( * ) Notice: Subject to any disclaimer, the term of this patent is extended or adjusted under 35 U.S.C. 154(b) by 206 days.

(21) Appl. No.: 14/339,627

(22) Filed: Jul. 24, 2014

(65) Prior Publication Data

US 2015/0101251 A1 Apr. 16, 2015

(30) Foreign Application Priority Data

Oct. 11, 2013 (CN) ..... 2013 1 0471842

(51) Int. Cl.

| | |
|---|---|
| ***E06B 5/12*** | (2006.01) |
| ***E05F 15/611*** | (2015.01) |
| ***E05D 15/00*** | (2006.01) |
| ***E05D 7/00*** | (2006.01) |
| ***E06B 5/18*** | (2006.01) |
| ***E06B 5/16*** | (2006.01) |
| ***E06B 1/52*** | (2006.01) |
| ***E05F 15/63*** | (2015.01) |
| ***E06B 3/36*** | (2006.01) |
| ***E06B 5/10*** | (2006.01) |
| *E05D 3/02* | (2006.01) |
| *E06B 3/70* | (2006.01) |

(52) U.S. Cl.

CPC ... *E06B 5/12* (2013.01); *E05D 7/00* (2013.01); *E05D 15/00* (2013.01); *E05F 15/611* (2015.01); *E05F 15/63* (2015.01); *E06B 1/52* (2013.01); *E06B 3/362* (2013.01); *E06B 5/10* (2013.01); *E06B 5/16* (2013.01); *E06B 5/164* (2013.01); *E06B 5/18* (2013.01); *E05D 3/02* (2013.01); *E05F 2015/631* (2015.01); *E06B 2003/703* (2013.01)

(58) Field of Classification Search

CPC ..... E06B 5/12; E06B 1/52; E06B 5/18; E06B 5/164; E06B 5/16; E05D 15/00; E05D 3/02; E05D 7/00; E05F 5/16

See application file for complete search history.

(56) References Cited

U.S. PATENT DOCUMENTS

| | | | | | |
|---|---|---|---|---|---|
| 2,996,322 | A | * | 8/1961 | McClellan | 292/36 |
| 3,499,183 | A | * | 3/1970 | Parsons | 16/273 |
| 4,281,481 | A | * | 8/1981 | Wendt | 49/504 |
| 4,561,147 | A | * | 12/1985 | Katoh et al. | 16/380 |

(Continued)

*Primary Examiner* — Katherine Mitchell
*Assistant Examiner* — Abe Massad
(74) *Attorney, Agent, or Firm* — CBM Patent Consulting, LLC

(57) ABSTRACT

A powered door for nuclear power plant consists of an embedded steel plate, a door frame welded on the embedded steel plate, a pair of hinge devices, a group of door panels, a group of opening and closing devices and a group of bolt devices; the door panels are fixedly arranged within the door frame through the hinge devices; the opening and closing devices are arranged at the upper ends of the door panels, and the bolt devices are arranged in the internal sides of the door panels. The powered door is fire-proof, explosion-proof and bullet-proof, and is safe and long in service life, thus, the powered door can be used for nuclear power engineering which is constructed based on new standards.

9 Claims, 6 Drawing Sheets

(56) References Cited

U.S. PATENT DOCUMENTS

| | | | | | |
|---|---|---|---|---|---|
| 4,714,282 | A * | 12/1987 | Henderson | 292/36 |
| 4,748,790 | A * | 6/1988 | Frangolacci | 52/794.1 |
| 5,103,592 | A * | 4/1992 | Janitzky | 49/401 |
| 5,553,871 | A * | 9/1996 | Rowe et al. | 277/644 |
| 7,000,550 | B1 * | 2/2006 | Mandall | 109/49.5 |
| 7,591,157 | B2 * | 9/2009 | O'Neill et al. | 70/118 |
| 8,671,620 | B2 * | 3/2014 | Bourget | 49/334 |
| 2011/0094160 | A1 * | 4/2011 | Houser | 49/31 |

* cited by examiner

POWERED DOOR FOR NUCLEAR POWER PLANT

FIELD OF THE INVENTION

The invention relates to a special door, in particular to an overweight huge powered door applied in nuclear power plant.

BACKGROUND OF THE INVENTION

As an emerging energy, nuclear power plant is featured with environmental-friendliness and high efficiency and attracts a lot of attention due to radiation brought by its power supplies. Door, as a channel connecting the nuclear power plant with outside, plays roles of room divider, seal, zoning, personnel access and so on. There are many internal rooms in the nuclear power plant with different functions and characteristics. The special door of the nuclear power plant is the final barrier for blocking internal rays, airflow and other pollutants in the nuclear power plant from connecting the outside. The construction quality of the powered door directly affects the quality of the last line of defense, and is more related to safety running of the nuclear power plant.

Since American '9.11' event, and aimed at the powered doors of nuclear power plants, it is requested that each door should have solid steel plates with a thickness of at least 152 mm, the side length of the door panel should be more than 4m, the net weight should be more than 30T, and moreover, the door should meet the special requirements of fire resistance, explosion resistance, bullet resistance, shock resistance and so on. This is the first powered door adopting such high requirements and large size in the world, thus, both the manufacturing difficulty and test difficulty are great.

SUMMARY OF THE INVENTION

Invention purpose: Aiming at the disadvantage of the prior art, the invention discloses a structure and a manufacturing process for an overweight powered door for nuclear power plant which is explosion-proof, anti-shock, fire-proof and bullet-proof.

Technical solution: The invention discloses a powered door for nuclear power plant. The powered door consists of an embedded steel plate, a door frame welded on the embedded steel plate, a pair of hinge devices, a group of door panels, a group of opening and closing devices and a group of bolt devices; the door panels are fixedly arranged within the door frame through the hinge devices; the opening and closing devices are arranged at the upper ends of the door panels, the bolt devices are arranged in the internal sides of the door panels, and fireproof sealing strips are adhered to surrounding of the door panels.

The hinge device comprises a door frame hinge A, a door frame hinge B and a door leaf hinge which are connected through one-way thrust ball bearings; the door frame hinge A, the door frame hinge B and the door leaf hinge are provided with explosion-proof bolts;

the door frame hinge A (9) is horizontally provided with two rows of explosion-proof bolts, and each row of explosion-proof bolts are three explosion-proof bolts which are arranged in equidistant;

the door frame hinge B is horizontally provided with three rows of explosion-proof bolts, and each row of explosion-proof bolts are three explosion-proof bolts which are arranged in equidistant;

the door leaf hinge is horizontally provided with three rows of explosion-proof bolts, and each row of explosion-proof bolts are three explosion-proof bolts which are arranged in equidistant.

The door panel comprises a basal plate, and two sides of the basal plate are respectively provided with a fixed frame, a fire protection layer reinforcement frame, a fireproof plate and a film faced plywood;

the basal plate is a rectangular ASTMA36 steel plate which is 4877-6096 mm in height, 4267-5791 mm in width and 148-180 mm in thickness;

the fixed frame is formed by welding steel with a thickness of 25-50 mm and a width of 22 mm at surrounding of both sides of the basal plate;

the fire protection layer reinforcement frame is a rectangular grid frame which is formed by welding 25-50 mm*30 mm*2.75 mm galvanized square tubes in the middle of the fixed frame and uniformly distributing the galvanized square tubes on the basal plate, and the size of each formed grid is 400 mm*300 mm;

the fireproof plate is a perlite fire protection layer with a thickness of 25-50 mm which is fixedly arranged on the door panel with glues in the grids formed by the fire protection layer reinforcement frame;

the film faced plywood is a cold rolled sheet with a thickness of 2 mm which is pressed on the fixed frame, the fire protection layer reinforcement frame and the fireproof plate;

and the door panel is a fireproof door panel with a thickness of 202-284 mm which is respectively covered with fireproof layers at two sides of the basal plate.

The closing and opening device comprises a transmission rod, a slideway and a limit device; one end of the transmission rod is fixedly connected with the output shaft of a drive motor, the other end of the transmission rod is provided with a fixed shaft, a rolling bearing, which is additionally arranged on the shaft, is embedded in the slideway; the slideway is connected with the door leaf through high-strength bolts; when the drive motor rotates to turn the transmission rod over, the other end of the transmission rod pushes the slideway to enable the door leaf to reach on/off functions; and the limit device is arranged on the cross beam of the door frame.

The bolt device comprises an upper bolt, a lower bolt, a bolt shell, a bolt plate, an upper transmission rod and a lower transmission rod; a positive internal thread and a negative internal thread are respectively processed at one end of the upper and lower bolts; a positive external thread and a negative external thread are processed at two ends of the upper and lower transmission rods; one end of the transmission rod is fixed on the output shaft of the locking drive motor, and the other end of the transmission rod is matched with the thread of the bolt to screw into the bolt hole; the bolt is inserted into the bolt shell; the bolt shell is connected with the door leaf through ASTMA325 high-strength bolts, and the bolt plate is welded on the embedded steel plate.

The rotational speed of the output shaft of the drive motor is 0.45-0.46 rpm, and the torque is 2000-3500 NM.

The rotational speed of the output shaft of the locking drive motor is 45-46 rpm, and the torque is 20-100 NM.

The door frame hinge A, door frame hinge B and door leaf hinge are made of ASTMA36 steel sheets, the one-way thrust ball bearing is made of ASTMA5140 round steel, and the explosion-proof bolt is made of ASTMA325 steel sheets.

The fireproof sealing strips are vulcanized rubber sealing strips with a thickness of 3 mm and a width of 30 mm.

The weight of the door is 19-45t, the size of the fixed bolt is M30, the material of the door body is ASTM A36, the material of hinge block is ASTM A36 and the material of hinge shaft is ASTMA5140. The minimum shear sections of door and wall hinges are respectively A1.

When the weight of the door is 19t, the maximum shear stress is:

$$P_1 = \frac{F_1}{2A_1} = \frac{G}{2A_1} = \frac{19000 \times 9.8}{2 \times 200 \times 50} MPa = 9.3\ MPa$$

then, $$P_1 < [\tau_s]_{A36}.$$

The shear force of the six bolts on the wall hinge block and the door hinge block is F1. When six bolts in two rows are verified, three bolts in one row (Z1) are sheared. The nominal stress cross section area of the bolts is A2.

The suffered shear stress of the bolts is $$P_2 = \frac{F_1}{2(2Z_1A_2)} = \frac{19000 \times 9.8}{2 \times 2 \times 3 \times 459} MPa = 33.8\ MPa$$

then, $$P_2 < [\tau_s]_{A325}.$$

The torque produced by balancing door weight is only subject to the top one set of hinges. The middle point of the one-way thrust ball bearing between the middle part hinge block and the lower part hinge block is taken as the support point to analyze the suffered torque balance force F2 of the upper hinge, and F2 is provided by the upper hinge shaft section A3.

$$F_2 = \frac{1497}{2939} G = \frac{1497}{2939} \times 19000 \times 9.8N = 9.5 \times 10^4 N$$

The shear stress of the upper hinge shaft is:

$$P_3 = \frac{F_3}{A_3} = \frac{F_2}{A_3} = \frac{9.5 \times 10^4}{25^2 \times \pi} MPa = 48.4\ MPa$$

then, $$P_3 < [\tau_s]_{A5140}.$$

The upper hinge block will suffer tensile force of F2. The maximum tensile stress of the stressed section of the upper hinge block is:

$$P_4 = \frac{F_2}{A_J} = \frac{9.5 \times 10^4}{200 \times 50} MPa = 9.5\ MPa$$

then, $$P_4 < [\sigma_s]_{A36}.$$

The shear force of the six bolts on the wall hinge block and the door hinge block is F1. When six bolts in two rows are verified, three bolts in one row (Z1) are sheared. The nominal stress cross section area of the bolts is A2.

The shear force of the six bolts on the upper hinge block is F1. When six bolts in three rows are verified, four bolts in two rows (Z2) are sheared. The nominal stress cross section area of the bolts is A2.

The suffered shear stress of the bolts is $$P_2 = \frac{F_2}{Z_2A_2} = \frac{9.5 \times 10^4}{4 \times 459} MPa = 51.7\ MPa$$

then, $$P_2 < [\tau_s]_{A5140}.$$

Table of Properties for Materials and Bolts

| | $\sigma_s$ (MPa) | $\sigma_b$ (MPa) | $[\sigma_8]$ (MPa) | $\tau_s$ (MPa) | $[\tau_s]$ (MPa) |
|---|---|---|---|---|---|
| ASTM A36 | 250 | 400~550 | 83 | 144 | 48 |
| ASTMA5140 | 785 | 900~980 | 262 | 316 | 105 |
| ASTMA325 | 640 | 800 | 213 | 370 | 123 |

In the present invention, multiple tests are carried out:

Product Bulletproof Test Method: UL752 Degree 4

Fix the test piece on a bracket, put testing cardboard behind the test piece to observe possible spatter. Shoot the test piece with a standard US-made M16 automatic rifle loaded with lead-zinc bullets by a professional person, if 4 bullets do not break down the test piece, and the back test cardboard does not change at all, the standard requirement is met.

Product Explosion-Proof Test Method: Equivalent Static Load Method

1. Laboratory construction: build a relatively sealed box-type laboratory. An opening needs to be reserved in the laboratory for installing and testing samples. A pressure test point must be established for the laboratory, the setting position of the pressure test point could not affect the fluid of the air compressor system. The laboratory must meet full-size installation of the detected door; the air compressor system compresses and supplies air to provide different air pressure values required by the entire sample. This system should be able to keep constant air pressure (at least more than 3 min) test time; the accuracy of the force measurement instrument should be ranged from −2% to 2%; in deflection measurement system, the deflection accuracy measured by the strain gauge should be +/−0.25 mm.

2. Test steps:

1) Use ASTM2247-03 program test;

2) The manufacturing dimensions of the test piece are 6100 mm*4887 mm, the test piece is an assembly (excluding electrical system) including door frame, door leaf, hinge and locking system.

3) Installation of test piece: install the test piece on the laboratory opening surface (steel structure support) by a preload model; the installation of the test piece should be able to reflect the actual use situation. The test piece is connected with the support structure by a steel structure. And meanwhile close the locking system.

4) Arrangement of air compressor system: the air compressor system should be able to keep constant air pressure.

5) Pressure test instrument: the layout of the pressure test instrument should not be affected by fluid during testing.

6) Pressure measurement:

a. Measure indoor pressure with a pressure sensor;

b. Measurement method: open the air compressor system, convey compressed air into the laboratory, when the laboratory comes to half-full load, stop pressurizing, keep 3 min at constant pressure, and record related measured data (pressure, holding time and deformation amount of test piece); after meeting the static load and holding time, slowly reduce the pressure difference to zero, record related data after 3 min, and determine whether the laboratory is deformed permanently.

3. Conformity criteria:

1) The test piece is not deformed (without permanent deformation), and after being unloaded, the door can be operated fully, the test piece is kept well and closed and opened freely;

2) after the test piece is downloaded, check whether the deflection meter is zero, and ensure that the deflection is no more than 2 mm;

3) the door can be opened;

4) confirm whether the door can be locked;

5) both the lock and hinge are out of any damages and permanent deformation phenomenon.

Fireproof performance: higher than China's GB12955-2008 fire door standard, and 3-hour fireproof performance reaches U.S. UL10B and 10C standards.

0. Preparation before fire-resistant test:

1. Preparation for test equipment:

1.1 Preparation for test furnace: test furnace (including instrument and apparatus, etc.) should pass through detection of related departments, and the effectiveness of the test result should be ensured.

1.2 Test piece preparation: test pieces (including the assembly of door frame, door leaf, hinge, fireproof layer, bolt and paint sealing strips) should be manufactured according to drawings and technical specifications, and have passed size, reliability, flexibility, explosion resistant detection tests.

1.3 Preparation for test piece mounting frame: the test piece frame is used for mounting the test piece. The test piece mounting frame is formed by splicing four concrete columns.

1.4 Preparation for hoisting equipment: the hoisting equipment is composed of a crane (lane), hanging ropes and hooks for hoisting the concrete frame columns, door frame and door leaf. Its load should be no less than 50 t.

1.5 Preparation for electric welding equipment: the door and the frame are combined by a welding method, namely, coated electrode manual arc welding, thus, applicable equipment such as welder, welding rod and welding gun should be prepared.

1.6 Preparation for steel pipe diagonal bracings: in order to enhance the firmness of the framework, and ensure that the framework always keeps in good condition under any situations, the external side of the vertical column of the framework should be provided with steel pipe diagonal bracings (four), and the diameter of the steel pipe should be no less than 150 mm.

1.7 Preparation for combustion equipment: the combustion equipment comprises gas, pipelines and valves. Due to long combustion time and large gas consumption, at least 5 bottles with 50 kg gas weight per bottle must be prepared. The gas bottles should be put at least 8 m away from the combustion furnace, and electric welding and other fire work are forbidden in surrounding 5*m* radius range. The diameter of gas pipelines should be no less than 30 mm.

1.8 Preparation for thermocouple: see specification and quantity of thermocouple in "Thermocouple layout".

1.9 Preparation for cotton balls: cotton balls are used for measuring the heat at test piece seams during combustion test. The cotton balls are bound on an iron wire with certain hardness, the length of the iron wire should meet the requirement that the operator can use the cotton balls to measure any parts of the test piece by standing on the ground. The cotton balls could not adopt the used cotton, and after the cotton balls are bound on the iron rod, loose the cotton by hand to keep a loosen state. At least 100 cotton balls should be prepared.

1.10 Preparation for baking oven: baking oven is used for baking cotton balls. After cotton balls are prepared, the cotton balls can be used only after being baked for half hour in a 100 baking oven.

1.11 Preparation for fireproof blockage: fireproof blockage is used for blocking gaps between the combustion furnace and the test piece, and adopts aluminum silicate fireproof fiber.

1.12 Preparation for various record forms: to ensure complete record of the test, before test, corresponding record forms should be compiled according to the test requirements, including time, temperature, pressure, water shock and records of various inspection after the test.

1.13 Preparation for chronograph watch: prepare a stopwatch and a watch respectively.

1.14 Preparation for electric equipment: as the thermocouple and the hoister need electricity, electric equipment such as wires and cables, distribution boards and power switches should be prepared in advance according to the requirement of the test.

1.15 Preparation for electric hoister: the electric hoister is used for shifting the combustion furnace, the power of the hoister should meet the requirement that the combustion furnace can slide on the railway without depending on other external forces.

1.16 Preparation for wedge-shaped wood blocks: when the door frame is installed, wedge-shaped wood blocks are adopted to fill the seams between the door frame and the framework, so that the door frame can be fixed temporarily, and the mounting position of the door frame can be calibrated through adjusting the wood block, the thickness of one end of the wood block is about 10 mm, and the thickness of the other end of the wood block is no more than 40 mm, and 20 wood blocks should be prepared.

1.17 Preparation for nondestructive testing equipment: in order to inspect the mounting and welding qualities of the door frame, after welding, visual inspection must be carried out firstly, and nondestructive test should also be carried out if necessary, thus, testing method should be determined in advance according to the seam features, and corresponding testing equipment should also be prepared.

1.18 Preparation for operators: see trainings of test operators and operators in 3.7 and 4.0 Before the test starts, the responsible person of the project should be responsible for recruiting all operators in place and making specific division of labor.

1.19 Preparation for safety protection equipment: in order to ensure no accident and no personnel injury incident occurring in the entire test, following safety protective measures must be adopted:

separate the test area with the outside, reserve an entrance, hang a warning board at the entrance, and meanwhile assign one person to be on duty to advise non-staff not to enter the test area.

All staff should be registered and checked by project manager for approval.

All staff must wear safety helmets, the Commerce Department should prepare helmets in advance, and the number of helmets should be determined according to the number of staff.

Electric welders should wear sunglasses, electrician gloves and work clothes. Cotton ball temperature measurement staff and water flow impact staff should also wear protective masks, and the Commerce Department should prepare the protective equipment in advance.

2. Design and manufacturing for concrete frame: the concrete frame is formed by splicing four concrete columns. The column is 600 mm in thickness and width, a reinforced frame is arranged in the middle of the column, and the length of the column is dependent on the height of the test piece. A 30 mm*360 mm steel plate is reserved along the height direction of one side of the middle part in the internal side of the column where the test piece is mounted; the steel plate is connected with the internal reinforced frame of the column. A steel plate is reserved at the welding and splicing part between two ends of the column, and the steel plate is also connected with the reinforced frame of the column; two vertical columns of the concrete frame and the upper beam are prefabricated on the flat ground, and the bottom beam is pre-cast in the frame mounting place. The prefabricated concrete columns can be used after 28 days.

3. Installation of framework:

3.1 The framework should be installed by qualified slingers and electric welders, and should be cooperatively carried out by workshop installers.

3.2 Installation of vertical frame and vertical column: tie the upper end of the vertical column with a suspension cable, start the crane to hang the vertical column vertically, slowly move the vertical column to the bottom beam of the framework, and vertically put the vertical column at one end of the bottom beam, after calibrating the perpendicularity, combine the vertical column of the framework and the bottom beam of the framework at the reserved steel plate by a welding method. Install the other vertical column with the same method. After the vertical columns are installed, check whether the perpendicularity of the vertical columns and the external sides of two vertical columns are in a same plane. In order to ensure the framework always keeping vertical state under any situations, two diagonal bracings made of round steel tubes should also be arranged at the external side of each vertical column, and the diagonal bracings are arranged at the upper part and middle part of the vertical side of the cement framework.

3.3 Installation of framework upper beam: tie the middle part of the upper beam with a suspension cable, start the crane to slowly move to the top of the upper beam, put the upper beam at the top of the vertical column, after calibrating the position, and combine the upper beam with the vertical column through a welding way. Now the installation of the framework is finished.

4. Installation of test piece door frame:

4.1 Firstly determine the mounting position of the door frame: the door frame is to be mounted at the middle part of the internal side of the framework. At first, draw a vertical line from top to bottom of the middle part of a steel plate embedded part in the inside of the framework, and make a vertical line mark with a pen.

Hang the welded and spliced door frame in advance to the framework by a crane, block the door frame and the inside of the framework with wedge-shaped wood blocks, fix the door frame in the framework temporarily, and keep surrounding seams uniform. And meanwhile calibrate the perpendicularity.

4.2 Combine the door frame with the embedded parts at upper, middle and lower positions of two sides outside and inside the door frame by a point-welding method. And check the height and perpendicularity, and perform full welding after meeting the requirement.

4.2 In order to eliminate stress, it is suggested to adopt a noncontinuous segmenting welding method, the welding should be carried out in sequence based on upper, lower, middle and front and back sequences until finishing welding. The welding process should be based on WX-WPS-2011 <Welding Process Regulations>.

4.3 After finishing welding, perform nondestructive testing for welds. After removing welding slags and sundries, check with a visual inspection method, if there is a suspected crack or other defects, perform MT inspection, and control the weld height about 20 mm.

5. Installation of door leaf: XXX should organize the workshop installers to mount door leafs. Move the door leaf to the framework formed by reinforced concrete by a crane through suspension ropes and lugs on the door leaf. After calibrating the perpendicularity and the flatness, install the door leaf on the door frame through hinges. After the door leaf is installed, check whether the door leaf can be closed in place, and check whether surrounding seams are uniform and whether the door leaf can be closed and opened flexibly.

After the components are installed, remove the suspension cables and the crane. Check the firmness of the installation again, ensure no risk occurring when the component drops caused by component deformation or other situations during the test.

6. Preparation for water flow impact test equipment:

Following test preparation should be done before water flow impact test:

establish a steel platform and a steel water gun rack, put the water gun rack on the platform, and the operator operates the water gun by standing on the platform. The top (placing the water gun) of the water gun rack is in equal height with the middle part of the test piece. The water gun is put on the water gun rack for operation during water flow impact.

Prepare a water tank, and the water tank can be filled with at least 15 $m^3$ water. The impact water is clean running water.

Prepare a spray gun composed of a hose with a diameter of 64.5 mm and a spray nuzzle with a diameter of 28.6 mm, and a boost gauge should be arranged on the spray nozzle.

Prepare a boost pump to enable the jetted water to keep a certain pressure.

Prepare a water distribution groove to enable the jetted water to distribute into the sewer.

Draw a straight line on the platform 6*m* away from the fire-exposed surface of the component as a start point for water flow jetting.

7. Trial burning of test furnace:

For smoothly carrying out fire resistance test, trial burning must be carried out before formal test. The procedures for trial burning are as follows:

7.1 Operators in place: see arrangement and training requirement of operators in 3.7 and 4.0. Before operation, all operators should check detection tools, record forms and finish other all preparations related to the test in advance. All operators should work on their respective operation posts. All operators cannot leave their posts before the test is finished and cannot be replaced by others, and all records should be intact.

7.2 Install fireproof cloth at the opening of the test furnace, and fix and seal the surroundings and middle part.

7.3 Check whether power supply, gas, gas pipelines, detection equipment and instrument and apparatus are in good and available conditions.

7.4 Arrange thermocouples at the unexposed surface of the test piece, see the number and position of the thermocouples in thermocouple layout.

7.5 Connect the power supply, open the valve of the gas bottle, ignite gas to heat the furnace. And meanwhile, starting timing, and observe the changes of temperature and pressure meters.

7.6 Control requirement for furnace temperature:

5 min: 538
10 min: 704
20 min: 795
30 min: 843
45 min: 892
1.0 h: 972
1.5 h: 978
2.0 h: 1010
3.0 h: 1052° C.

7.7 Measure the temperature of the fire-exposed surface of the component every 1 minute, the measurement point can be selected randomly, and the number of temperature measurement points in each time should be no less than 4.

7.8 Measure the temperature of the unexposed surface of the component every 1 minute within 30 minutes after the test starts, the measurement point can be selected randomly, and the number of temperature measurement points in each time should be no less than 3. The thermocouples can be removed after 30 min.

In the fire resistant test, in addition to measure and record the temperature changes, the pressure changes in the furnace should also be observed in every 1 minute.

7.9 Temperature measurement by cotton balls: temperature measurement by cotton balls should be carried out by a special person. Measure the temperature in every 10 minutes, use the cotton balls bound on the iron wire to measure the temperatures of all seams 25 mm away from the test piece in fixed points, and check the furnace flame or heat leakage phenomena. A cotton ball can only be used once; do not use the burned (roasted) cotton ball. Make records in each detection.

7.10 When the temperature reaches 1052° C. and the combustion time is 3 h, the fire resistant test for the test piece is finished. Turn off the power and cut off the gas supply immediately. Flame out the furnace. Perform water flow impact test immediately after the fire resistant test is stopped within 1.5 min to 3 min.

8. Test data check: after the test is finished, check all test data, including time, temperature, pressure and so on, and timely make summary, rectification and improvement to obtain successful test experience.

9. Fire resistant test for door assembly:

9.1 Combustion furnace reset: hoist the combustion furnace to the front of the cement concrete framework by the electric crane, tamp and compact the seams between the cement framework and the combustion furnace walls with fireproof materials (aluminum silicate fiber). Flames in the combustion furnace should be prevented from getting outside during the test.

9.2 Test method: the test method and trial burning method or rectified test method should be carried out.

10. Water flow impact test:

10.1 Water flow impact test must be carried out after the fire resistant test is stopped within 1.5 min to 3 min. Firstly remove the combustion furnace to enable the exposed surface of the test piece to face the position of the water flow spray gun. And then start the boost pump, start the water gun and adjust the water pressure, so that the spraying pressure comes to 45 psi.

10.2 The test person should stand on a 6 m high platform, put the spray gun on the spray gun rack, aim at the test piece and spray the test piece from bottom center and then gradually move upwards until all exposed surfaces of the test piece are sprayed. And meanwhile, ensure that the spray duration of each square foot should be no less than 3 s.

10.3 After the water flow impact test is finished, and naturally cooled to the normal temperature, remove the assembly from the concrete framework, flatly put it on a wood pad and perform inspection.

10.0. Conformity criteria:

The fire resistant time should be 3 h, and the furnace temperature should meet the requirement of UL10B3/UL10C4.

The flame broken down the unexposed surface should not exceed the range specified by UL10B13.1/UL10C15.1.

After the test piece passes through fire resistant test and water flow impact, the components thereof should keep intact (operability is not required).

The amount of deformation of the test piece should meet the requirements of UL10C 15.2 15.3 15.4 15.5.

The pressure in the furnace should meet the requirement of UL10C7.

The fire resistant performance test is accredited by American INTERTEK, in continuous 3 h 1200° C. high temperature combustion, the exposed surface of the door is not dissolved and deformed, and moreover, in the weakest place of the door seam in the unexposed surface, the medical cotton balls are not ignited while getting close the door seams 2.5 cm within 10-30 s.

Beneficial effects: The powered door for nuclear power plant disclosed by the invention is fire-proof, explosion-proof and bulletproof, and is safe and long in service life, thus, the powered door can be used for nuclear power engineering which is constructed based on new standards.

DETAILED DESCRIPTION OF THE EMBODIMENTS

Figure 1:
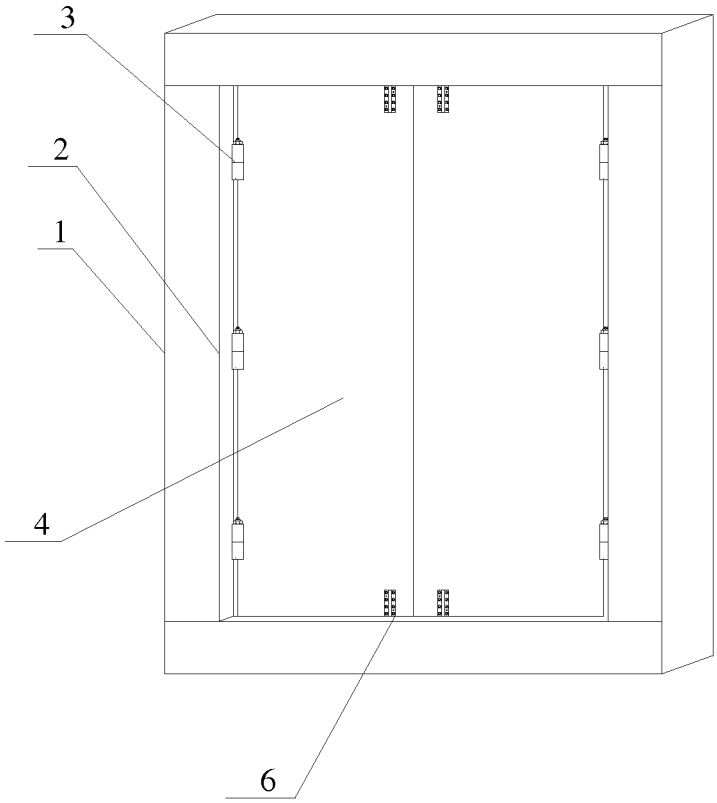
FIG. 1 is a simple diagram of the powered door for nuclear power plant.
Figure 2:
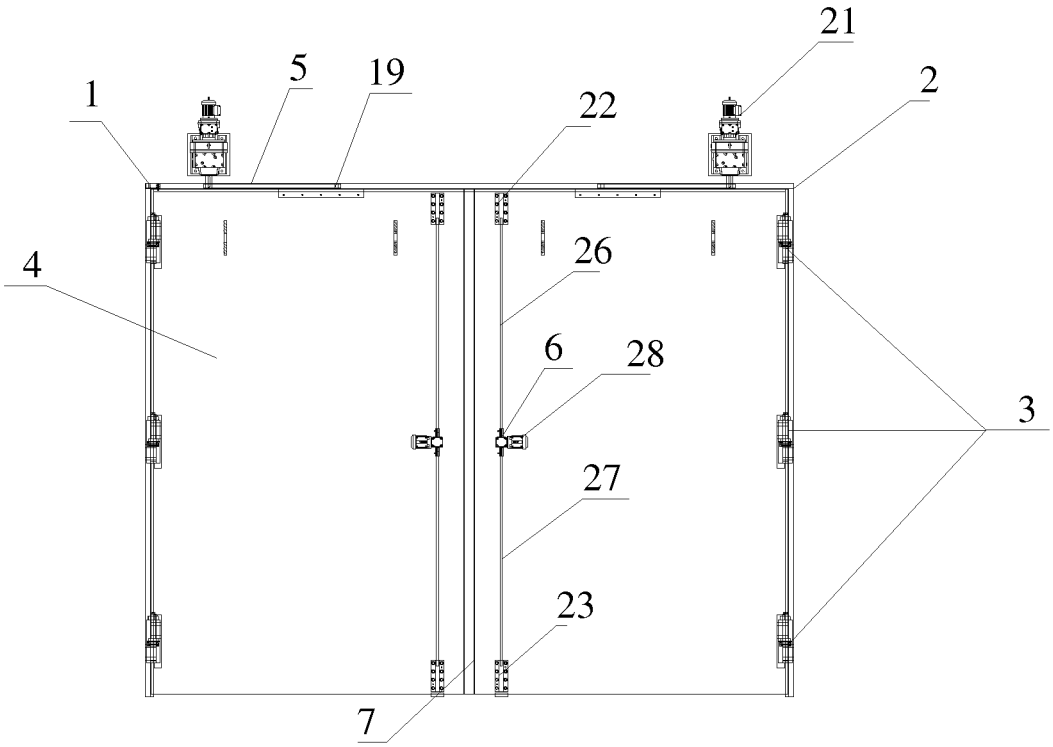
FIG. 2 is a schematic diagram of the powered door for nuclear power plant.
Figure 3:
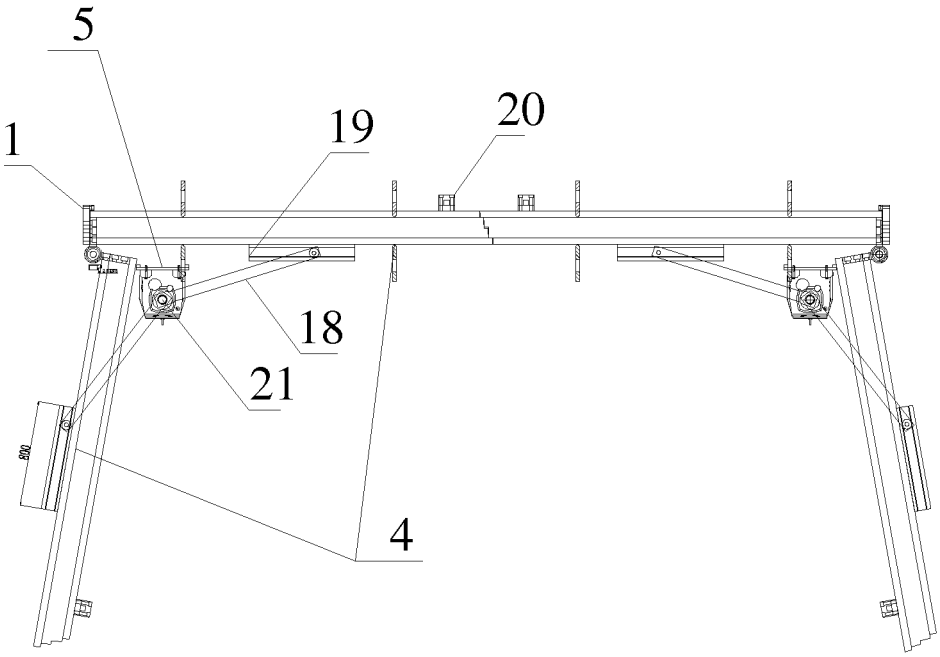
FIG. 3 is a schematic diagram of the opening and closing device of the powered door for nuclear power plant.
Figure 4:
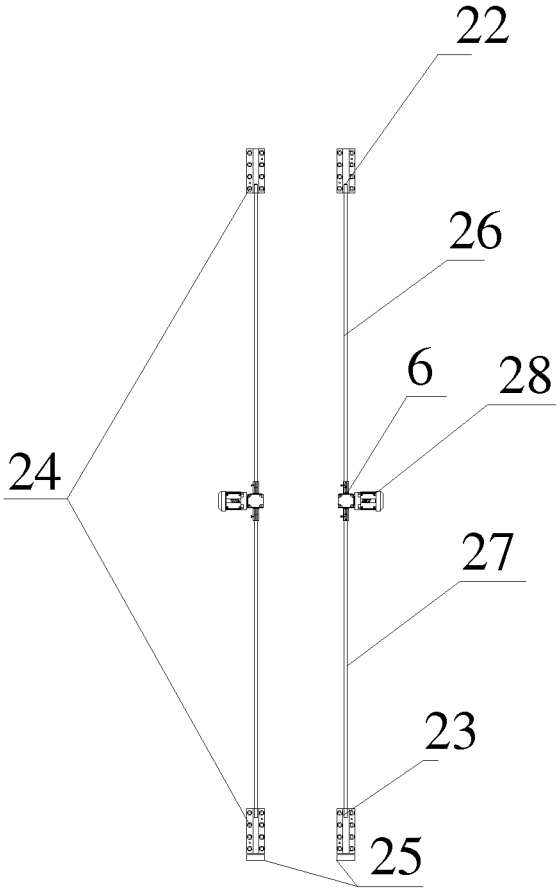
FIG. 4 is a schematic diagram of the bolt device of the powered door for nuclear power plant.
Figure 5:
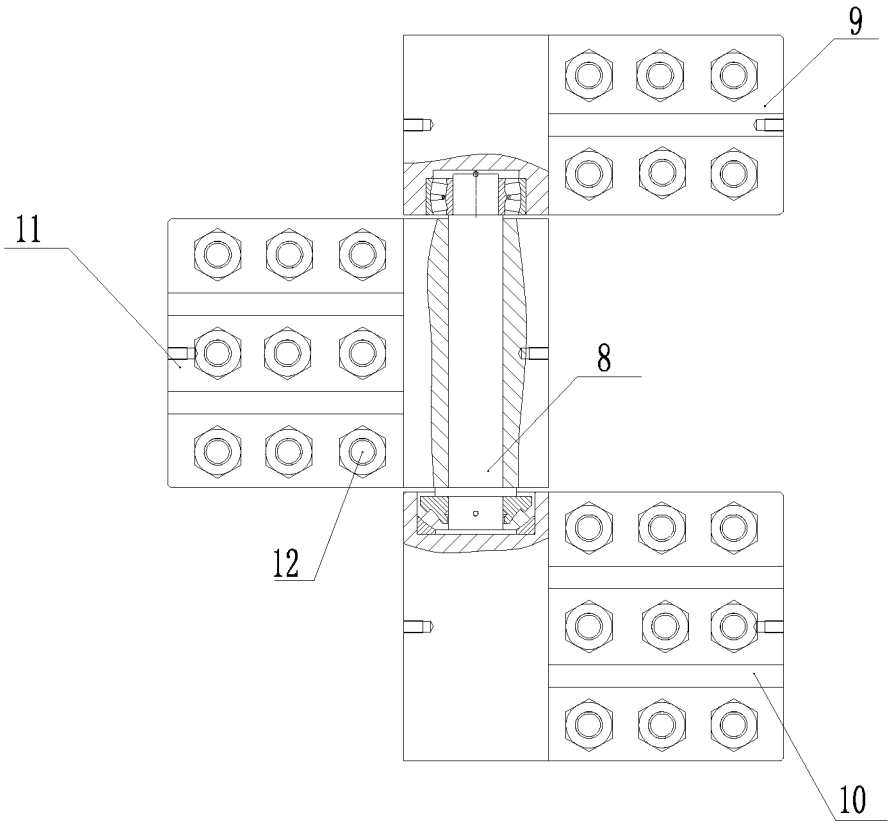
FIG. 5 is a schematic diagram of the hinge device of the powered door for nuclear power plant.
Figure 6:
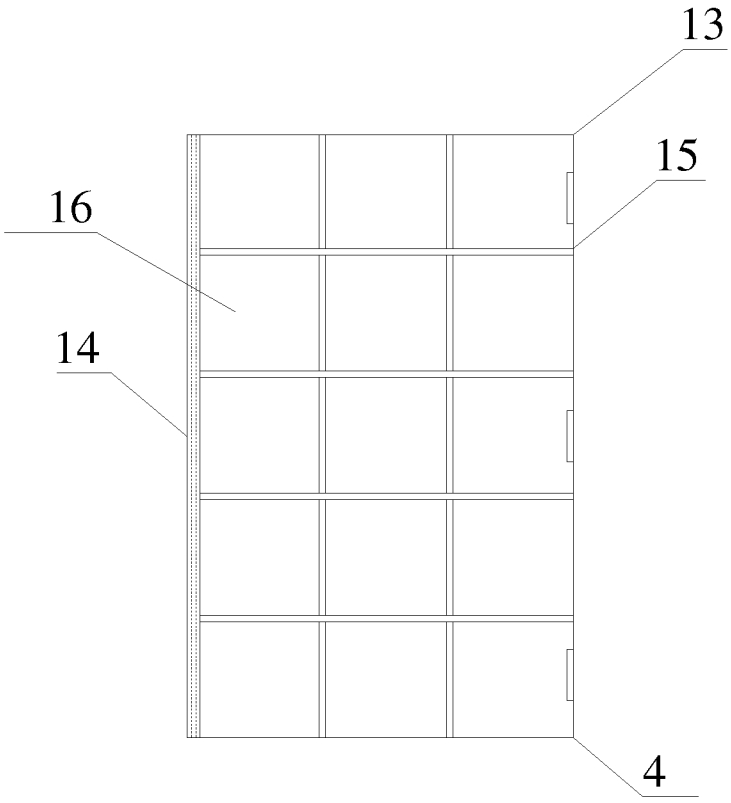
FIG. 6 is a schematic diagram of door panel of the powered door for nuclear power plant.
Figure 7:
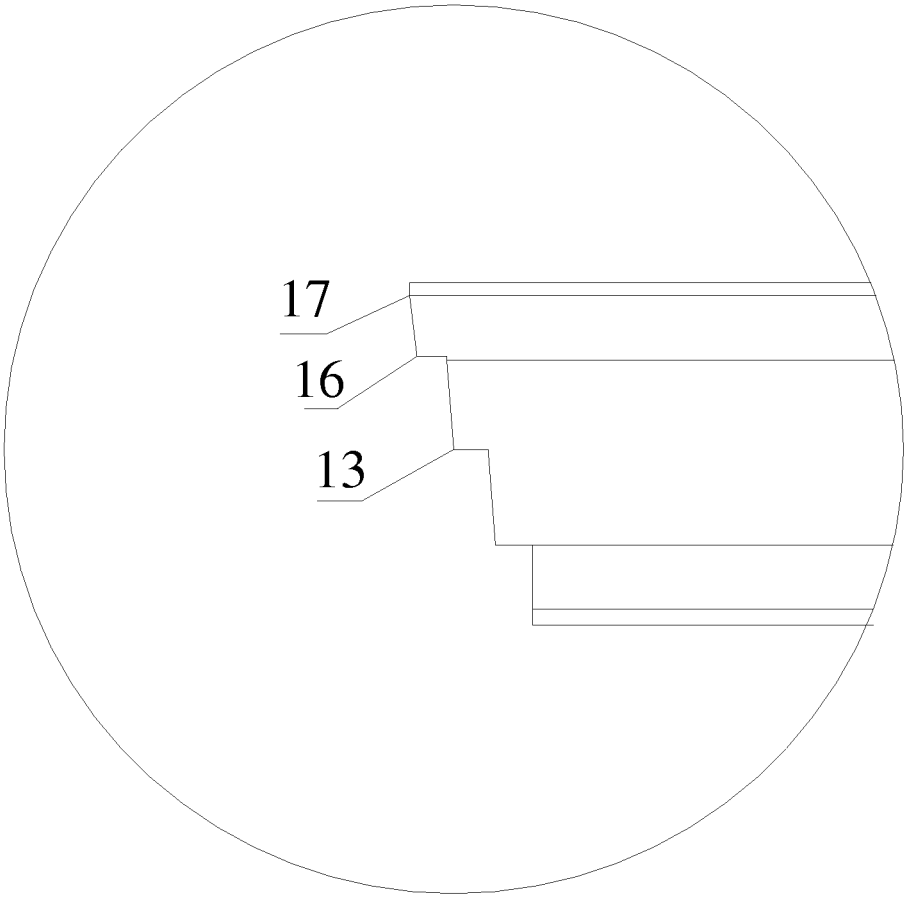
FIG. 7 is a sectional view of door panel of the powered door for nuclear power plant.

The following accompanying drawings and embodiments of the present invention will be further explanation.

The invention discloses a powered door for nuclear power plant. The powered door comprises an embedded steel plate 1, a door frame 2 welded on the embedded steel plate 1, a pair of hinge devices 3, a group of door panels 4, a group of opening and closing devices 5 and a group of bolt devices 6; the door panels 4 are fixedly arranged within the door frame 2 through the hinge devices 3; the opening and closing devices 5 are arranged at the upper ends of the door panels 4, the bolt devices 5 are arranged in the internal sides of the door panels 4; and fireproof sealing strips 7 are adhered to surrounding of the door panels 4.

Embodiment 1

The invention discloses a powered door for nuclear power plant. The powered door consists of an embedded steel plate, a door frame welded on the embedded steel plate, a pair of hinge devices, a group of door panels, a group of opening and closing devices and a group of bolt device; the door panels are fixedly arranged within the door frame through the hinge devices; the opening and closing devices are arranged at the upper ends of the door panels, the bolt devices are arranged in the internal sides of the door panels, and fireproof sealing strips are adhered to surrounding of the door panels.

The hinge device comprises a door frame hinge A, a door frame hinge B and a door leaf hinge which are connected through one-way thrust ball bearings; the door frame hinge A, the door frame hinge B and the door leaf hinge are provided with explosion-proof bolts;

the door frame hinge A is horizontally provided with two rows of explosion-proof bolts, and each row of explosion-proof bolts are three explosion-proof bolts which are arranged in equidistant;

the door frame hinge B is horizontally provided with three rows of explosion-proof bolts, and each row of explosion-proof bolts are three explosion-proof bolts which are arranged in equidistant;

the door leaf hinge is horizontally provided with three rows of explosion-proof bolts, and each row of explosion-proof bolts are three explosion-proof bolts which are arranged in equidistant.

The door panel comprises a basal plate, and two sides of the basal plate are respectively provided with a fixed frame, a fire protection layer reinforcement frame, a fireproof plate and a film faced plywood;

the basal plate is a rectangular ASTMA36 steel plate which is 6096 mm in height, 4877 mm in width and 180 mm in thickness;

the fixed frame is formed by welding steel with a thickness of 50 mm and a width of 22 mm at surrounding of both sides of the basal plate;

the fire protection layer reinforcement frame is a rectangular grid frame which is formed by welding 50 mm*30 mm*2.75 mm galvanized square tubes in the middle of the fixed frame and uniformly distributing the galvanized square tubes on the basal plate, and the size of each formed grid is 400 mm*300 mm;

the fireproof plate is a perlite fire protection layer with a thickness of 25-50 mm which is fixedly arranged on the door panel with glues in the grids formed by the fire protection layer reinforcement frame;

the film faced plywood is a cold rolled sheet with a thickness of 2 mm which is pressed on the fixed frame, the fire protection layer reinforcement frame and the fireproof plate;

and the door panel is a fireproof door panel with a thickness of 284 mm which is respectively covered with fireproof layers at two sides of the basal plate.

The closing and opening device comprises a transmission rod, a slideway and a limit device; one end of the transmission rod is fixedly connected with the output shaft of a drive motor, the other end of the transmission rod is provided with a fixed shaft, a rolling bearing, which is additionally arranged on the shaft, is embedded in the slideway; the slideway is connected with the door leaf through high-strength bolts; when the drive motor rotates to turn the transmission rod over, the other end of the transmission rod pushes the slideway to enable the door leaf to reach on/off functions; and the limit device is arranged on the cross beam of the door frame.

The bolt device comprises an upper bolt, a lower bolt, a bolt shell, a bolt plate, an upper transmission rod and a lower transmission rod; a positive internal thread and a negative internal thread are respectively processed at one end of the upper and lower bolts; a positive external thread and a negative external thread are processed at two ends of the upper and lower transmission rods; one end of the transmission rod is fixed on the output shaft of the locking drive motor, and the other end of the transmission rod is matched with the thread of the bolt to screw into the bolt hole; the bolt is inserted into the bolt shell; the bolt shell is connected with the door leaf through ASTMA325 high-strength bolts, and the bolt plate is welded on the embedded steel plate.

The rotational speed of the output shaft of the drive motor is 0.45 rpm, and the torque is 3500 NM.

The rotational speed of the output shaft of the locking drive motor is 45 rpm, and the torque is 100 NM.

The door frame hinge A, door frame hinge B and door leaf hinge are made of ASTMA36 steel sheets, the one-way thrust ball bearing is made of ASTMA5140 round steel, and the explosion-proof bolt is made of ASTMA325 steel sheets.

The fireproof sealing strips are vulcanized rubber sealing strips with a thickness of 3 mm and a width of 30 mm.

Embodiment 2

The invention discloses a powered door for nuclear power plant. The powered door consists of an embedded steel plate, a door frame welded on the embedded steel plate, a pair of hinge devices, a group of door panels, a group of opening and closing devices and a group of bolt device; the door panels are fixedly arranged within the door frame through the hinge devices; the opening and closing devices are arranged at the upper ends of the door panels, the bolt devices are arranged in the internal sides of the door panels, and fireproof sealing strips are adhered to surrounding of the door panels.

The hinge device comprises a door frame hinge A, a door frame hinge B and a door leaf hinge which are connected through one-way thrust ball bearings; the door frame hinge A, the door frame hinge B and the door leaf hinge are provided with explosion-proof bolts;

the door frame hinge A is horizontally provided with two rows of explosion-proof bolts, and each row of explosion-proof bolts are three explosion-proof bolts which are arranged in equidistant;

the door frame hinge B is horizontally provided with three rows of explosion-proof bolts, and each row of explosion-proof bolts are three explosion-proof bolts which are arranged in equidistant;

the door leaf hinge is horizontally provided with three rows of explosion-proof bolts, and each row of explosion-proof bolts are three explosion-proof bolts which are arranged in equidistant.

The door panel comprises a basal plate, and two sides of the basal plate are respectively provided with a fixed frame, a fire protection layer reinforcement frame, a fireproof plate and a film faced plywood;

the basal plate is a rectangular ASTMA36 steel plate which is 4877 mm in height, 4267 mm in width and 148 mm in thickness;

the fixed frame is formed by welding steel with a thickness of 25 mm and a width of 22 mm at surrounding of both sides of the basal plate;

the fire protection layer reinforcement frame is a rectangular grid frame which is formed by welding 25 mm*30 mm*2.75 mm galvanized square tubes in the middle of the fixed frame and uniformly distributing the galvanized square tubes on the basal plate, and the size of each formed grid is 400 mm*300 mm;

the fireproof plate is a perlite fire protection layer with a thickness of 25-50 mm which is fixedly arranged on the door panel with glues in the grids formed by the fire protection layer reinforcement frame;

the film faced plywood is a cold rolled sheet with a thickness of 2 mm which is pressed on the fixed frame, the fire protection layer reinforcement frame and the fireproof plate;

and the door panel is a fireproof door panel with a thickness of 202 mm which is respectively covered with fireproof layers at two sides of the basal plate.

The closing and opening device comprises a transmission rod, a slideway and a limit device; one end of the transmission rod is fixedly connected with the output shaft of a drive motor, the other end of the transmission rod is provided with a fixed shaft, a rolling bearing, which is additionally arranged on the shaft, is embedded in the slideway; the slideway is connected with the door leaf through high-strength bolts; when the drive motor rotates to turn the transmission rod over, the other end of the transmission rod pushes the slideway to enable the door leaf to reach on/off functions; and the limit device is arranged on the cross beam of the door frame.

The bolt device comprises an upper bolt, a lower bolt, a bolt shell, a bolt plate, an upper transmission rod and a lower transmission rod; a positive internal thread and a negative internal thread are respectively processed at one end of the upper and lower bolts; a positive external thread and a negative external thread are processed at two ends of the upper and lower transmission rods; one end of the transmission rod is fixed on the output shaft of the locking drive motor, and the other end of the transmission rod is matched with the thread of the bolt to screw into the bolt hole; the bolt is inserted into the bolt shell; the bolt shell is connected with the door leaf through ASTMA325 high-strength bolts, and the bolt plate is welded on the embedded steel plate.

The rotational speed of the output shaft of the drive motor is 0.46 rpm, and the torque is 2000 NM.

The rotational speed of the output shaft of the locking drive motor is 46 rpm, and the torque is 20 NM.

The door frame hinge A, door frame hinge B and door leaf hinge are made of ASTMA36 steel sheets, the one-way thrust ball bearing is made of ASTMA5140 round steel, and the explosion-proof bolt is made of ASTMA325 steel sheets.

The fireproof sealing strips are vulcanized rubber sealing strips with a thickness of 3 mm and a width of 30 mm.

Embodiment 3

The invention discloses a powered door for nuclear power plant. The powered door consists of an embedded steel plate, a door frame welded on the embedded steel plate, a pair of hinge devices, a group of door panels, a group of opening and closing devices and a group of bolt device; the door panels are fixedly arranged within the door frame through the hinge devices; the opening and closing devices are arranged at the upper ends of the door panels, the bolt devices are arranged in the internal sides of the door panels, and fireproof sealing strips are adhered to surrounding of the door panels.

The hinge device comprises a door frame hinge A, a door frame hinge B and a door leaf hinge which are connected through one-way thrust ball bearings; the door frame hinge A, the door frame hinge B and the door leaf hinge are provided with explosion-proof bolts;

the door frame hinge A is horizontally provided with two rows of explosion-proof bolts, and each row of explosion-proof bolts are three explosion-proof bolts which are arranged in equidistant;

the door frame hinge B is horizontally provided with three rows of explosion-proof bolts, and each row of explosion-proof bolts are three explosion-proof bolts which are arranged in equidistant;

the door leaf hinge is horizontally provided with three rows of explosion-proof bolts, and each row of explosion-proof bolts are three explosion-proof bolts which are arranged in equidistant.

The door panel comprises a basal plate, and two sides of the basal plate are respectively provided with a fixed frame, a fire protection layer reinforcement frame, a fireproof plate and a film faced plywood;

the basal plate is a rectangular ASTMA36 steel plate which is 4877 mm in height, 5791 mm in width and 152 mm in thickness;

the fixed frame is formed by welding steel with a thickness of 50 mm and a width of 22 mm at surrounding of both sides of the basal plate;

the fire protection layer reinforcement frame is a rectangular grid frame which is formed by welding 50 mm*30 mm*2.75 mm galvanized square tubes in the middle of the fixed frame and uniformly distributing the galvanized square tubes on the basal plate, and the size of each formed grid is 400 mm*300 mm;

the fireproof plate is a perlite fire protection layer with a thickness of 25-50 mm which is fixedly arranged on the door panel with glues in the grids formed by the fire protection layer reinforcement frame;

the film faced plywood is a cold rolled sheet with a thickness of 2 mm which is pressed on the fixed frame, the fire protection layer reinforcement frame and the fireproof plate;

and the door panel is a fireproof door panel with a thickness of 256 mm which is respectively covered with fireproof layers at two sides of the basal plate.

The closing and opening device comprises a transmission rod, a slideway and a limit device; one end of the transmission rod is fixedly connected with the output shaft of a drive motor, the other end of the transmission rod is provided with a fixed shaft, a rolling bearing, which is additionally arranged on the shaft, is embedded in the slideway; the slideway is connected with the door leaf through high-strength bolts; when the drive motor rotates to turn the transmission rod over, the other end of the transmission rod pushes the slideway to enable the door leaf to reach on/off functions; and the limit device is arranged on the cross beam of the door frame.

The bolt device comprises an upper bolt, a lower bolt, a bolt shell, a bolt plate, an upper transmission rod and a lower transmission rod; a positive internal thread and a negative internal thread are respectively processed at one end of the upper and lower bolts; a positive external thread and a negative external thread are processed at two ends of the upper and lower transmission rods; one end of the transmission rod is fixed on the output shaft of the locking drive motor, and the other end of the transmission rod is matched with the thread of the bolt to screw into the bolt hole; the bolt is inserted into the bolt shell; the bolt shell is connected with the door leaf through ASTMA325 high-strength bolts, and the bolt plate is welded on the embedded steel plate.

The rotational speed of the output shaft of the drive motor is 0.45 rpm, and the torque is 3000 NM.

The rotational speed of the output shaft of the locking drive motor is 45 rpm, and the torque is 50 NM.

The door frame hinge A, door frame hinge B and door leaf hinge are made of ASTMA36 steel sheets, the one-way thrust ball bearing is made of ASTMA5140 round steel, and the explosion-proof bolt is made of ASTMA325 steel sheets.

The fireproof sealing strips are vulcanized rubber sealing strips with a thickness of 3 mm and a width of 30 mm.

The invention discloses ideas and methods of a powered door for nuclear power plant, the technical scheme can be realized through many methods and means, said embodiments are only the preferable embodiments of the present invention. It should be noted that under the premise of without departing the principle of the present invention, the ordinary technicians in the technical field can make many improvements and modifications, however, these improvements and modifications can also be deemed as the claimed scope of the present invention.

What is claimed is:

1. A powered door for a nuclear power plant, the powered door comprising an embedded steel plate (1), a door frame (2) welded on the embedded steel plate (1), a pair of hinge devices (3), a group of door panels (4), a group of opening and closing devices (5) and a group of bolt devices (6); wherein the door panels (4) are installed in the door frame (2) through the hinge devices (3); the opening and closing devices (5) are arranged at upper ends of the door panels (4), the bolt devices (6) are arranged within the door panels (4); and fireproof sealing strips (7) are adhered to the peripheries of the door panels (4); wherein:

each of the hinge devices (3) comprises a first door frame hinge part (9), a second door frame hinge part (10) and a door leaf hinge part (11), wherein the first door frame hinge part, the second door frome hinge part, and the door leaf hinge part are connected through a one-way thrust ball bearing (8); and the first door frame hinge part (9), the second door frame hinge part (10) and the door leaf hinge part (11) are provided with explosion-proof bolts (12);

the first door frame hinge part (9) is provided with two parallel rows of explosion-proof bolts (12), each row of explosion-proof bolts (12) having three evenly spaced explosion-proof bolts (12);

the second door frame hinge part (10) is provided with three parallel rows of explosion-proof bolts (12), each row of explosion-proof bolts (12) having three evenly spaced explosion-proof bolts (12);

the door leaf hinge part (11) is horizontally provided with three rows of explosion-proof bolts (12), each row of explosion-proof bolts (12) having three evenly spaced explosion-proof bolts (12);

wherein the door panels are fireproof door panels with a thickness of 202-284 mm, each of the door panels (4) further comprising a basal plate (13) having two sides, each of the sides being provided with a fixed frame (14), a fire protection layer reinforcement frame (15), a fireproof plate (16) and a film faced plywood (17); wherein the basal plate (13) is a rectangular ASTM36 steel plate which is 4877-6096 mm in height, 4267-5791 mm in width and 148-180 mm in thickness;

the fixed frame (14) is formed by welding steel with a thickness of 25-50 mm and a width of 22 mm at the peripheries of both sides of the basal plate (13);

the fire protection layer reinforcement frame (15) is a rectangular grid frame which is formed by welding galvanized square tubes in a space formed within the fixed frame (14) and uniformly distributing the galvanized square tubes on the basal plate (13) to form a plurality of grids, such that the size of each grid is 400 mm*300 mm;

the fireproof plate (16) is a perlite fire protection layer with a thickness of 25-50 mm which is adhered to the basal plate (13) within the grids formed by the fire protection layer reinforcement frame (15); and the film faced plywood (17) includes a metal sheet with a thickness of 2 mm, wherein the film faced plywood is pressed on the fixed frame (14), the fire protection layer reinforcement frame (15) and the fireproof plate (16).

2. The powered door according to claim 1, wherein each of the closing and opening devices (5) comprises a transmission rod (18), a slideway (19) and a limit device (20); wherein one end of the transmission rod (18) is fixedly connected with an output shaft of a drive motor (21) and the other end of the transmission rod is provided with a fixed shaft, wherein the drive motor provides the output shaft with a rotational speed and a torque; a rolling bearing, the rolling bearing arranged on the shaft, and guided within the slideway (19); wherein the slideway (19) is connected with the door panel (4) through high-strength bolts; wherein when the drive motor (21) rotates to turn the transmission rod (18), the transmission rod (18) pushes the slideway (19) to enable the door panel (4) to reach an on or off switch; wherein the limit device (20) is arranged on the cross beam of the door frame (2).

3. The powered door according to claim 1, wherein the bolt device (6) comprises an upper bolt (22), a lower bolt (23), an upper bolt shell (24), a lower bolt shell (24), an upper bolt plate (25), a lower bolt plate (25), an upper transmission rod (26) and a lower transmission rod (27); wherein a positive internal thread and a negative internal thread are respectively provided at a lower end of the upper bolt (22) and an upper end of the lower bolt (23); a positive external thread and a negative external thread are respectively provided at an upper end of the upper transmission rod (26) and a lower end of the lower transmission rod (27);

a lower end of the upper transmission rod (26) and an upper end of the lower transmission rod (27) are fixed on the output shaft of a locking drive motor (28);

the threads of the upper end of the upper transmission rod (26) and the lower end of the lower transmission rod 27) are matched with the threads of the lower end of the upper bolt (22) and the upper end of the lower bolt (23), respectively, to screw into bolt holes of the upper and lower bolts;

the upper bolt (22) and the lower bolt (23) are respectively inserted into the upper bolt shell (24) and the lower bolt shell (24); and the bolt shells (24) are connected with the door panels (4) by ASTM325 high-strength bolts, and the bolt plate (25) is welded on the embedded steel plate (1).

4. The powered door according to claim 2, wherein the rotational speed of the output shaft of the drive motor (21) is 0.45-0.46 rpm, and the torque is 2000-3500 NM.

5. The powered door according to claim 2, wherein the rotational speed of the output shaft of the locking drive motor (28) is 45-46 rpm, and the torque is 20-100 NM.

6. The powered door according to claim 1, wherein the fireproof sealing strips (7) are vulcanized rubber sealing strips with a thickness of 3 mm and a width of 30 mm.

7. The powered door according to claim 1, wherein the first door frame hinge part (9), the second door frame hinge part (10) and the door leaf hinge part (11) are made of ASTM36 steel sheets, the one-way thrust ball bearing (8) is made of ASTM5140 round steel, and the explosion-proof bolts (12) are ASTM325 steel bolts.

8. The powered door according to claim 2, wherein the rotational speed of the output shaft of the drive motor (21) is 0.45-0.46 rpm, and the torque is 2000-3500 NM.

9. The powered door according to claim 3, wherein each bolt device further comprises a locking drive motor with an output shaft, wherein the rotational speed of the output shaft of the locking drive motor (28) is 45-46 rpm, and the torque is 20-100 NM.

* * * * *